US005592991A

United States Patent [19]

Lembcke et al.

[11] Patent Number: 5,592,991

[45] Date of Patent: Jan. 14, 1997

[54] METHOD AND APPARATUS OF INSTALLING A WHIPSTOCK

[75] Inventors: Jeffrey J. Lembcke, Houston; Henry J. Jordan, Jr., Conroe, both of Tex.

[73] Assignee: Baker Hughes Inc., Houston, Tex.

[21] Appl. No.: 455,177

[22] Filed: May 31, 1995

[51] Int. Cl.[6] ..... E21B 29/00

[52] U.S. Cl. ..... 166/298; 166/117.6

[58] Field of Search ..... 166/117.6, 206, 166/123, 382, 378, 381, 298

[56] References Cited

U.S. PATENT DOCUMENTS

| | | | |
|---|---|---|---|
| 3,908,759 | 9/1975 | Cagle et al. | 166/117.6 |
| 4,765,404 | 8/1988 | Bailey et al. | 166/117.6 |
| 5,109,924 | 5/1992 | Jurgens et al. . | |
| 5,154,231 | 10/1992 | Bailey et al. | 166/117.6 X |
| 5,193,620 | 3/1993 | Braddick | 166/382 |
| 5,195,591 | 3/1993 | Blount et al. | 166/380 |
| 5,277,251 | 1/1994 | Blount et al. | 166/117.5 |
| 5,341,873 | 8/1994 | Carter et al. . | |
| 5,443,129 | 8/1995 | Bailey et al. | 166/117.6 X |

OTHER PUBLICATIONS

Baker Oil Tools, Permanent Packer Systems, Model "D" and "DB" Retainer Production Packer, date unknown.

Baker Oil Tools, Permanent Packer Systems, Electric Wireline Packer Setting, Model "E-4" Wireline Pressure Setting Assembly, Model "L" Hi-Temp Wireline Pressure Setting Assembly, date unknown.

Baker Oil Tools, Permanent Packer Systems, Model "BH" Setting Tool Model "BHH" Setting Tool, date unknown.

Baker Oil Tools, Permanent Packer Systems, Model "DW-1" Whipstock Packer, Model "W-2" Whipstock Anchor Assembly, date unknown.

A-Z/Grant International, Casing Sidetrack Systems, date unknown.

*Primary Examiner*—Frank Tsay
*Attorney, Agent, or Firm*—Rosenblatt & Redano PC

[57] ABSTRACT

A one-trip system for milling a window using a whipstock is disclosed. The whipstock can be set on a packer or anchor which can be an electric line-type packer which, without modifications, can be set with the hydraulic mechanism disclosed so as to avoid the need for running a wireline rig. The assembly of the packer or anchor and whipstock is run into the wellbore in a single trip, with a mill or mills capable of milling a window. At the conclusion of the milling, the mill or mills are retrieved. Thereafter, a retrieving tool is attached to the whipstock and facilitates a release of the setting tool from the packer so that the setting tool and the whipstock are retrieved together. This leaves a seal bore within the packer which can be employed with a subsequent tubing string run through the packer so that production can be obtained through the packer as well as through the deviated wellbore while potential leakpaths in the packer from the annulus to the tubing are eliminated by the withdrawal of the setting assembly.

19 Claims, 8 Drawing Sheets

METHOD AND APPARATUS OF INSTALLING A WHIPSTOCK

FIELD OF THE INVENTION

The field of this invention relates to placement of whipstocks in conjunction with packers or anchors and more particularly to systems where the whipstock can be positioned in one trip and the setting assembly in the packer is removable.

BACKGROUND OF THE INVENTION

Prior systems for setting whipstocks have employed wireline-set packers, which generally require specialized equipment at the surface to properly position the packer in the wellbore. Thereafter, an electric signal is sent from the surface to the packer to initiate a reaction which creates pressure which, in turn, creates relative movement to set the packer and release therefrom. These systems involve multiple trips into the wellbore with such packers as the Baker Hughes model DW-1, which was an electric wireline-set packer. Generally, these packers have orienting keyways and various survey subs would be run into the wellbore with the packer to obtain the necessary readings on the orientation of the keyway within the packer. Subsequently on a separate run, the whipstock would be installed into the packer after the setting tool was removed with the wireline.

Because electric line-set packers required the running of the electric line to the packer, it was not possible with that design to run the packer and whipstock into the well in one trip.

In some instances, the portion of the wellbore below the packer would also continue to be in service, meaning that not only would there be production through the newly created deviated wellbore but production would also continue through the newly set packer which had supported the whipstock. In known hydraulically set designs, portions of the setting mechanism, such as setting pistons and seals, were integral to the packer. These seals presented potential leakpaths from the annulus to the tubing later mounted to the packer should such seals fail.

Various techniques for positioning and orienting whipstocks have been developed, such as illustrated in U.S. Pat. No. 5,341,873. One-trip milling techniques when using a whipstock are illustrated in U.S. Pat. No. 5,109,924.

Other systems have proclaimed to be one-trip systems but, in fact, have required multiple trips to mill a window to create a deviation in an existing wellbore. The systems developed by A-Z Grant International for casing sidetrack systems, under a system called "Pack-Stock®" and "Anchor Stock" have claimed to be a one-trip system but have, in fact, required the whipstock to be run in with a starter mill. Subsequently, another trip into the well was necessary to replace the starter mill to finish the milling operation. This system also did not address the issue of the leakpaths in the packer if the setting mechanism, whether located above or below the packer, is left in the wellbore upon removal of the whipstock. The Z-S system required a specially designed packer and did not provide for release of the whipstock and setting tool from the packer. This system could not use a standard wireline-set packer in a one-trip system. The principal problems of past systems were that either a two-trip system was required to avoid the leakpath problem by using a wireline, or a multiple-trip system was required that left various setting pistons and their seals in the packer body for potential tubing/annulus leakpaths.

Accordingly, it is an object of the present invention to provide a one-trip system, with the additional benefits that upon removal of the whipstock, the setting mechanism for the packer is removed, thereby eliminating potential annulus-to-tubing leakpaths in prior design packers. Additionally, wireline-set packers can be run with the apparatus and method of the present invention without need of a wireline rig. A single window-cutting mill can also be employed as one of the objects of the invention so that upon setting of the packer, the milling can begin on the same trip until the window is finished. The whipstock can then be retrieved with a variety of retrieving tools in a manner that will bring out the setting tool for the packer.

SUMMARY OF THE INVENTION

A one-trip system for milling a window using a whipstock is disclosed. The whipstock can be set on a packer or anchor which can be an electric line-type packer which, without modifications, can be set with the hydraulic mechanism disclosed so as to avoid the need for running a wireline rig. The assembly of the packer or anchor and whipstock is run into the wellbore in a single trip, with a mill or mills capable of milling a window. At the conclusion of the milling, the mill or mills are retrieved. Thereafter, a retrieving tool is attached to the whipstock and facilitates a release of the setting tool from the packer so that the setting tool and the whipstock are retrieved together. This leaves a seal bore within the packer which can be employed with a subsequent tubing string run through the packer so that production can be obtained through the packer as well as through the deviated wellbore while potential leakpaths in the packer from the annulus to the tubing are eliminated by the withdrawal of the setting assembly.

DETAILED DESCRIPTION OF THE PREFERRED EMBODIMENT

Figure 1A:
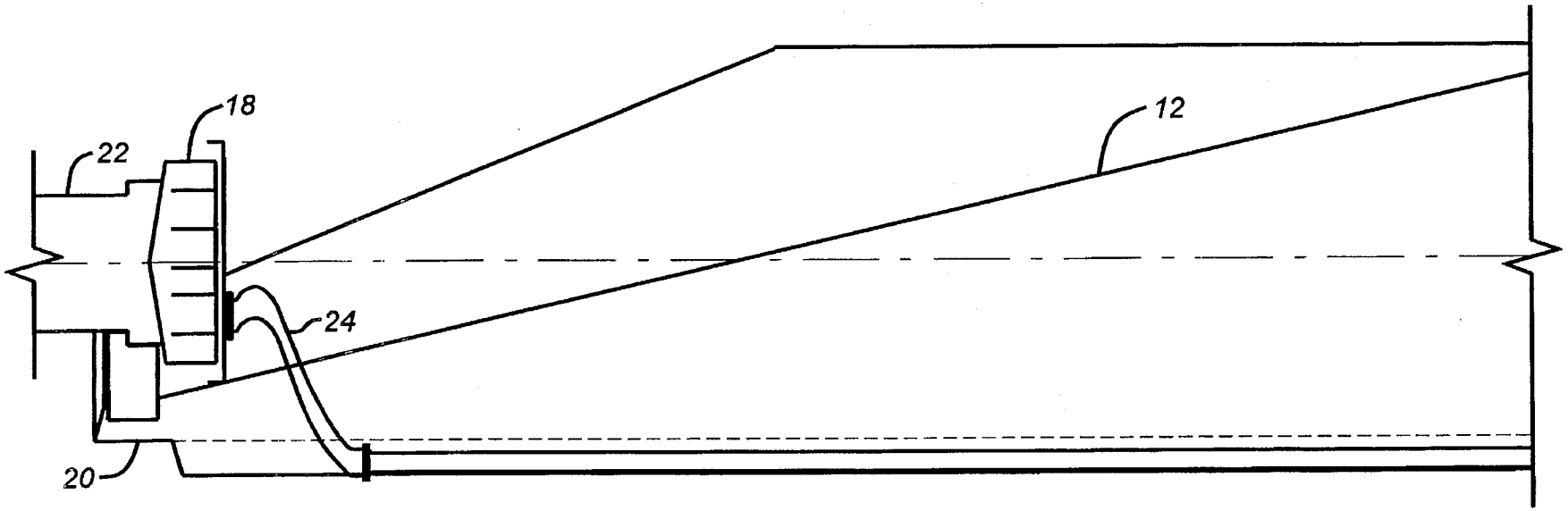
FIG. 1*a–c* illustrates the apparatus of the present invention in the run-in position in sectional elevational view.
Figure 1B:
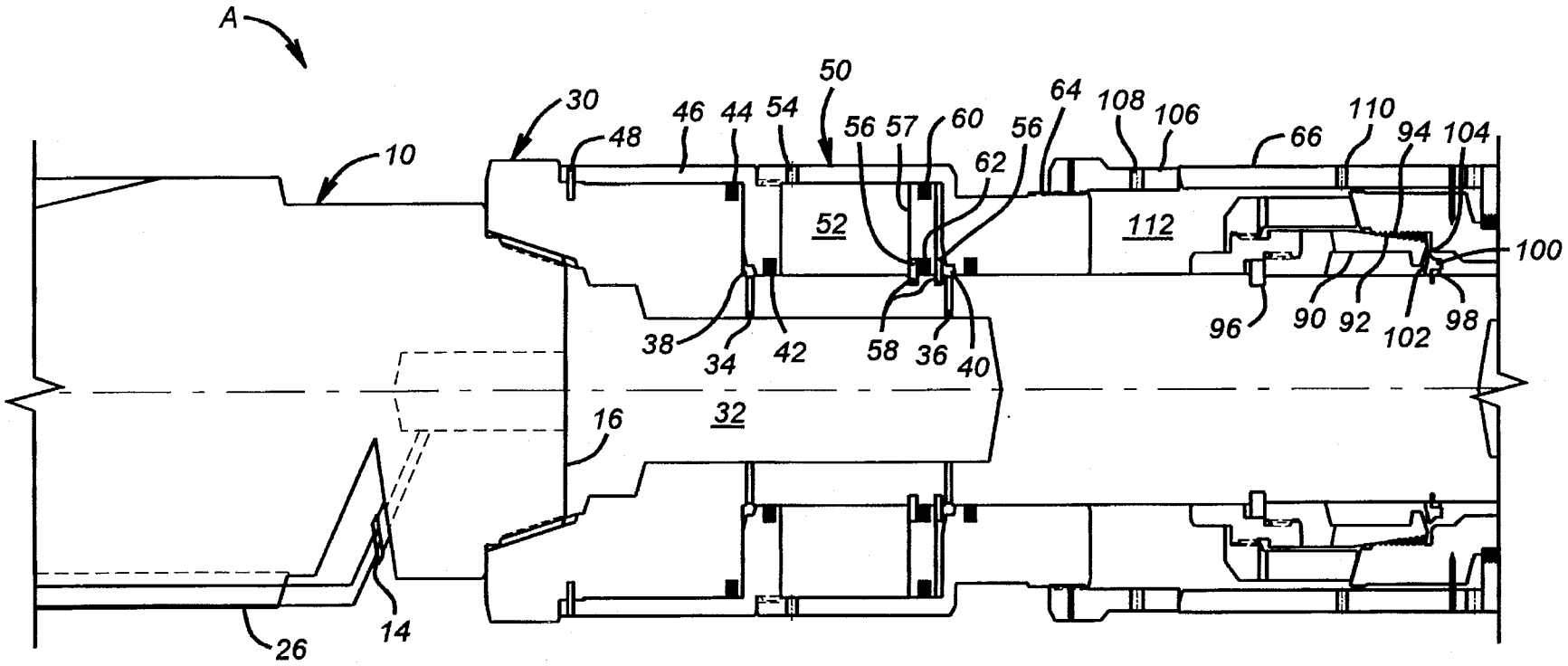
Figure 1C:
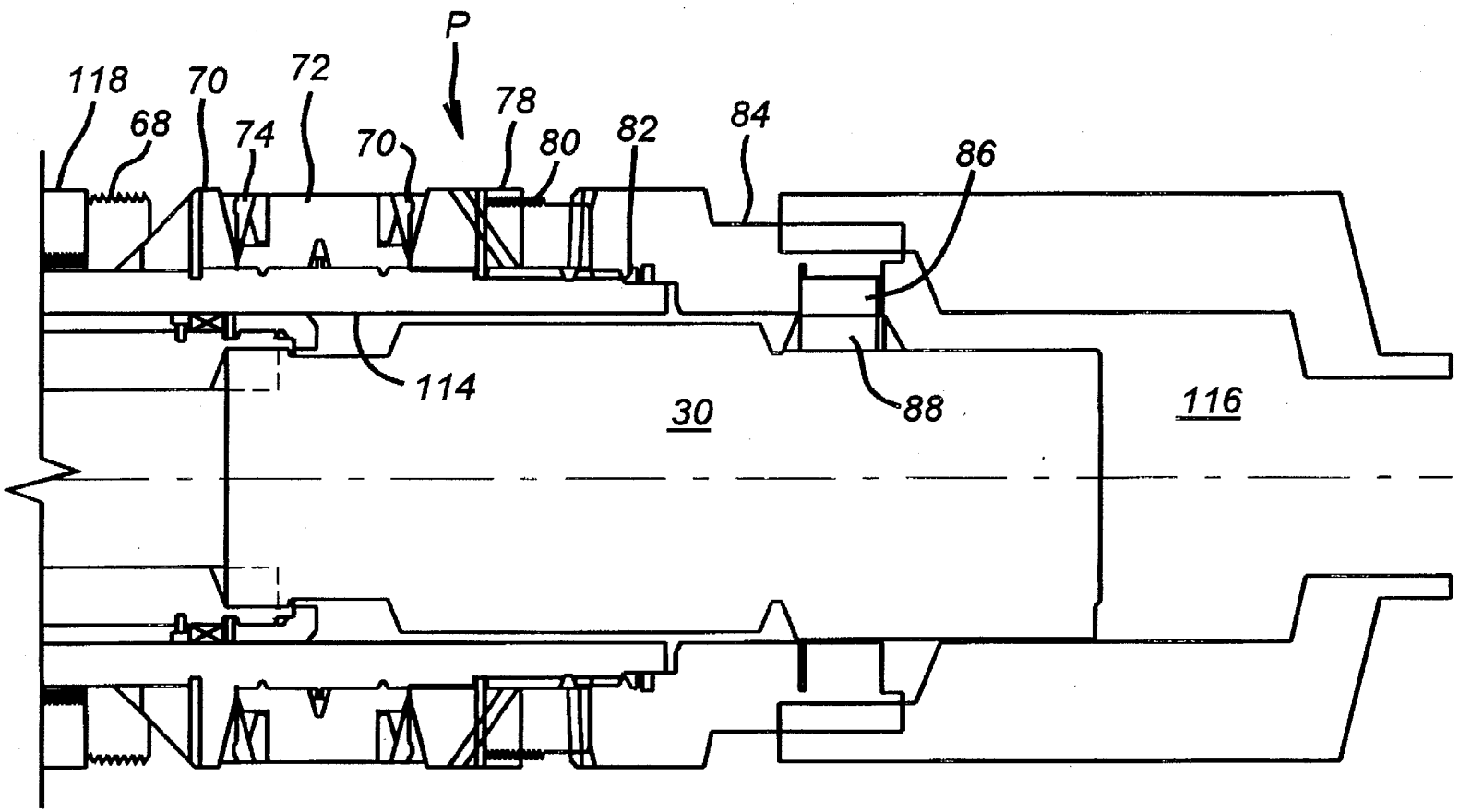
Figure 3:
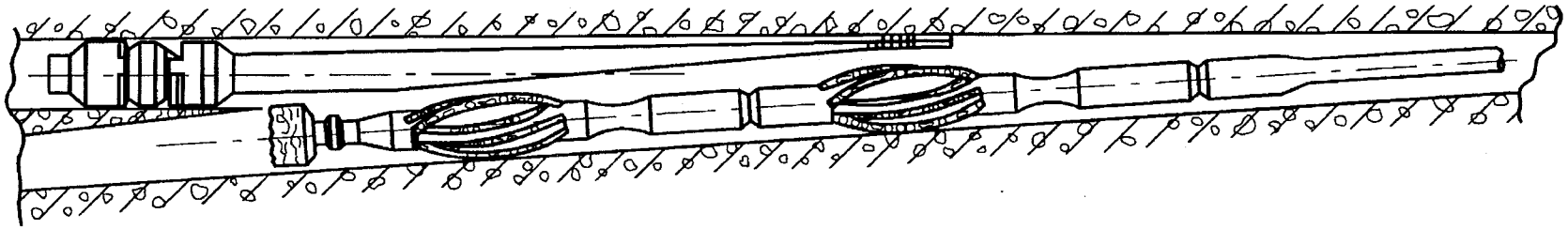
FIG. 3 illustrates a milling assembly that in a single trip mills a window using a whipstock, a window mill, and one or more watermelon mills.

The apparatus A of the present invention is illustrated in FIG. 1. A whipstock 10 has a tapered milling surface 12. A hydraulic connection 14 is located near the base 16 of whipstock 10. FIG. 1 illustrates the run-in position with the window-cutting mill 18 secured to upper end 20 of whipstock 10. In the preferred embodiment, the mill 18 is a schematic representation of the mill assembly described in U.S. Pat. No. 5,109,924 (and shown in FIG. 3), which shows a window mill in series with one or more "watermelon" mills. Shown schematically in FIG. 1 is a string 22 which is used to support the mill 18 attached to the whipstock 10. The string 22 is in fluid communication with a hose 24, which extends down to hydraulic connection 14 at the base 16 of the whipstock 10. Hose 24 may run through a sleeve 26 on the backside of the whipstock 10 facing away from the tapered surface 12. Whipstock 10 has a threaded connection 28 to which is secured inner mandrel 30. A cavity 32 is formed between the mandrel 30 and whipstock 10 and is in fluid communication with connection 14 such that hydraulic pressure applied from the string 22 communicates through hose 24 into connection 14 and thereafter into cavity 32. From cavity 32, applied hydraulic pressure enters ports 34 and 36. Port 34 leads to cavity 38, while port 36 leads to cavity 40. Seals 42 and 44 seal off cavity 38 and allow accumulated hydraulic pressure in cavity 38 to bear down on piston 46. The initial position of piston 46 shown in FIG. 1 is secured by shear pin 48, which breaks upon movement of piston 46. In the preferred embodiment, piston 46 bears on piston 50. Between pistons 46 and 50 is a cavity 52, which is vented at port 54. Spacer 57 is retained to mandrel 30 by a flexible clip or clips 56 which are sprung into grooves 58 in mandrel 30. Seals 60 and 62 seal, respectively, between the spacer 57 and the mandrel 30. Accordingly, chamber or cavity 52 decreases in size as piston 46 moves downwardly with respect to mandrel 30 toward spacer 57. On the other hand, cavity 40 increases in size as pressure comes via port 36 to add a boost force onto piston 50. It should be noted that the arrangement of pistons 46 and 50 gives the tool a lower profile while at the same time allowing the appropriate force to be transmitted through threaded connection 64 to setting sleeve 66 of the packer P. "Packer" is used in this application to refer interchangeably to a packer or a plug, whether retrievable or permanent.

Figure 2A:
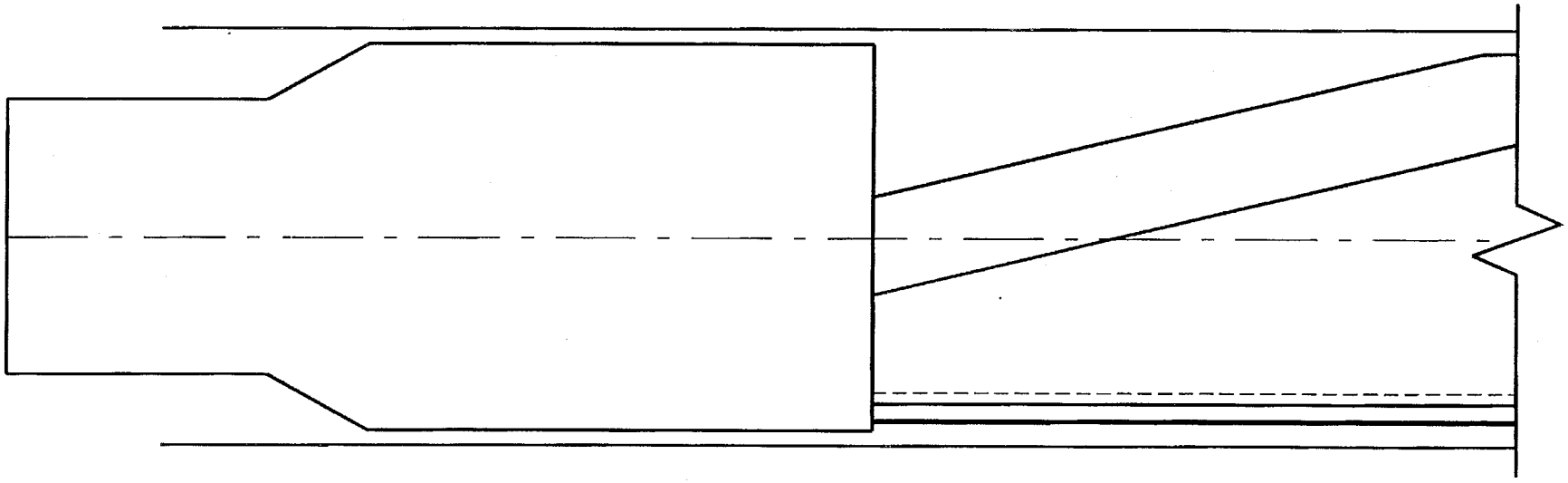
FIG. 2*a–d* shows the apparatus of the present invention in the packer-set position with a retrieving tool having effectuated a shear release for removal of the whipstock with the setting tool.
Figure 2B:
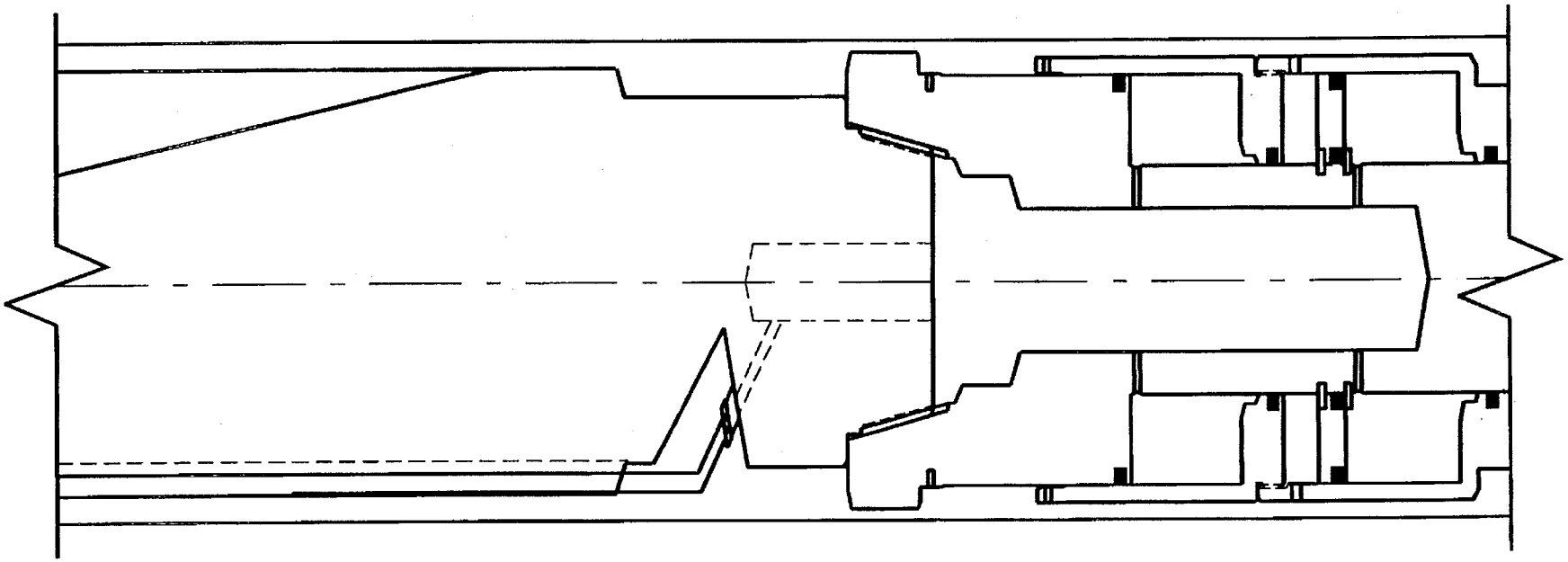
Figure 2C:
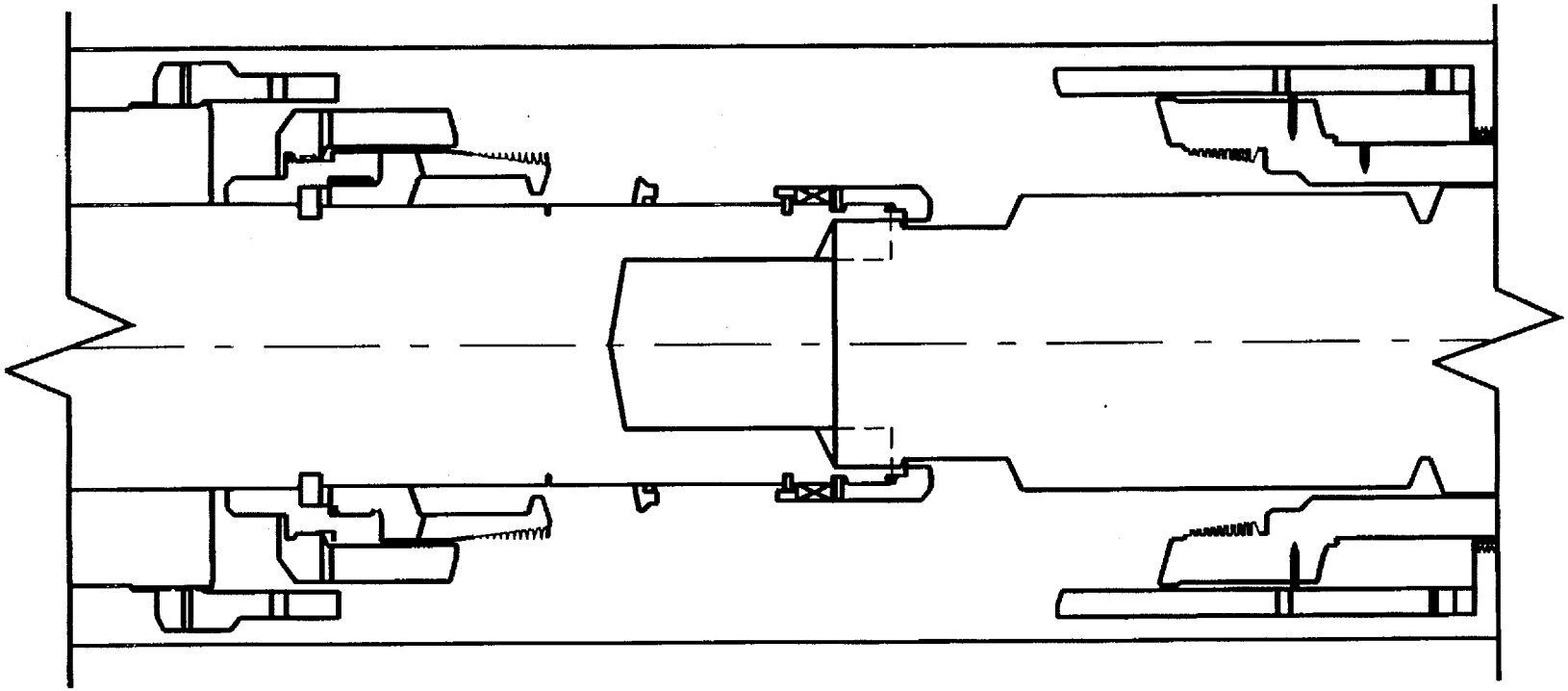
Figure 2D:
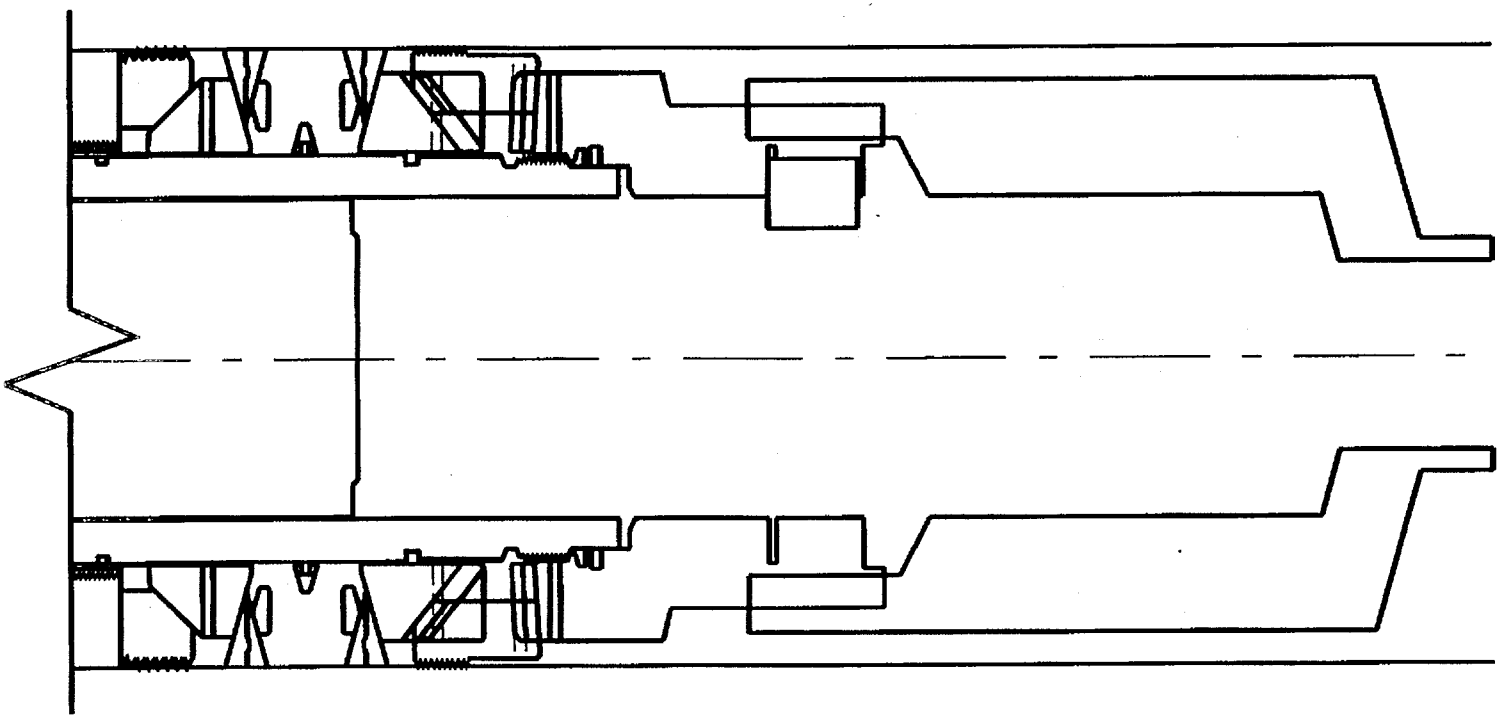

Packer P has the typically found features such as upper slip 68 adjacent upper cone 70. A sealing element 72 has anti-extrusion rings 74 and 76 on either side. A lower cone 78 urges lower slip 80 into contact with the casing or wellbore (not shown). The set position of the packer P is illustrated in FIG. 2*d*. Packer P has an inner mandrel 82 which is connected to a bottom sub 84. Bottom sub 84 has an orientation groove 86 into which fits an orientation lug 88 which is attached to mandrel 30.

Completing the description of the features of the apparatus A for setting the packer P, the mandrel 30 has a plurality of outwardly biased fingers 90 which have a thread 92 on their exterior to mate with thread 94 on inner mandrel 82. The position of fingers 90 is secured longitudinally to the mandrel 30 by a snap ring 96. A shear ring 98 extends from mandrel 30 and is covered by ring 100. Ring 100 has a tapered surface 102 which is designed to interact with tapered surface 104 if tension is applied to mandrel 30. In the position shown in FIG. 1 and during the milling operation with mill 18, the lugs 88 are in groove 86 to provide torsional resistance to forces created by mill 18. Grooves 86 also allow for orientation for subsequent operations if a different deviation is desired based on a whipstock supported by packer P. The initial gap between tapered surfaces 102 and 104 facilitates assembly of the mandrel 30 to the inner mandrel 82 of the packer P. During normal operations of milling with mill 18 against the tapered surface 12, the mandrel 30 will experience a compressive force which will result in the gap illustrated between tapers 102 and 104.

A release of the mandrel 30 from the packer P can be accomplished by an upward pull on the whipstock 10 with a retrieving tool T, as illustrated in FIG. 2. When the whipstock 10 is pulled upwardly, shear ring 98 breaks. Fingers 90 are then pulled upwardly due to the retrieving tool T and are no longer prevented from flexing radially inwardly. Thread 92 then separates from thread 94, whereupon a release can be accomplished.

The setting of the packer P is accomplished by applying hydraulic pressure into cavity 32, which forces the arrangement of tandem pistons 46 and 50 to move against setting sleeve 66 due to ring 106, which bears on it and is engaged to piston 50 at thread 64. Various vents 108 and 110 are provided to facilitate the escape of fluid from cavity 112.

The packer P has a polished bore 114 which is available for accepting packing or other types of external seals on tubing that can subsequently be run into the packer P after the whipstock 10 is removed if subsequent production is to occur through packer P through passageway 116.

The apparatus A described above can be readily adapted to a standard wireline-set packer so that, without modification, inner mandrel 30 can retain the packer P while ring 106 moves a sleeve to set such a packer. According to the apparatus A and method of the present invention, the assembly illustrated in FIG. 1, in conjunction with appropriate surveying subs, is run into the wellbore as a unit. Upon obtaining the proper orientation for tapered surface 12, using the known surveying equipment, the packer is set using hydraulic pressure provided through string 22 through hose 24 which ultimately results in movement of the pistons 46 and 50 to set the packer P by moving sleeve 66. At that time, the packer P is set and its set position is retained by lock ring 118. The milling can be then done in one step using a mill 18 in the manner taught by U.S. Pat. No. 5,109,924, which is incorporated by reference herein as if fully set forth. Once the retrieving tool T is inserted into the wellbore to retrieve the whipstock 10 at the completion of the milling operation, the mandrel 30 comes out with the whipstock 10, exposing the honed or polished bore 114 and taking out the series of pistons and all their associated seals which were used to actuate the sleeve 66. Those skilled in the art will appreciate that the lower end of the mandrel 30 comprises of the orienting lug structure 88 to facilitate orientation to groove 86 of bottom sub 84.

The onset of the milling with mill 18 severs line 24, but at that time the packer P is already set, with its set position retained by lock ring 118.

The hydraulically set mechanism, as described above, can be oriented either above or below the packer P. The configuration illustrated in FIGS. 1 and 2 allows the use of wireline-set packers without having to place a wireline rig at the surface since the setting mechanism of the pistons, such as 46 and 50 described above, can be secured to a wireline-set packer to actuate it hydraulically in the one-trip system illustrated in FIGS. 1 and 2. The system described is truly a one-trip system which eliminates the need for wireline rig and allows the window to be milled with the mill assembly 18 that is initially run with the whipstock 10 and packer P. Finally, the added advantage of eliminating leakpaths and presenting a polished bore 114 is that conventional sealing systems can be used when tubing is inserted into the packer P for production through the passageway 116 after the window is cut using the whipstock 10. Prior packer designs employed in conjunction with whipstocks 10 left the setting mechanism in the packer, thereby creating a potential for a variety of leakpaths through the O-ring seals used to actuate the pistons to set the prior design packers. The setting mechanism disclosed herein, operating in conjunction with the whipstock 10, effectively removes the various O-ring seals and pistons used to actuate the setting sleeve 66 to address this shortcoming of the prior art.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of milling a window downhole, comprising:

providing a packer without the setting components;

assembling a hydraulically actuated selectively removable setting tool to said packer;

assembling a whipstock to said packer or setting tool;

assembling a milling apparatus to the whipstock;

lowering the assembly of the milling apparatus, whipstock, setting tool, and packer into a well;

setting the packer with said setting tool;

milling a window with the milling apparatus.

2. A method of milling a window downhole: comprising:

providing a packer without the setting components;

assembling a hydraulically actuated setting tool to said packer:

assembling a whipstock to said packer or setting tool:

assembling a milling apparatus to the whipstock;

lowering the assembly of the milling apparatus, whipstock, setting tool, and packer into a well;

setting the packer with said setting, tool;

milling a window with the milling apparatus;

removing the setting tool from the packer when the whipstock is removed at the conclusion of said milling.

3. The method of claim 2, further comprising:

exposing a seal bore in the packer after removal of the setting tool;

running tubing into the packer;

sealing the tubing against the seal bore in the packer.

4. The method of claim 3, further comprising:

retaining the setting tool to the packer with at least one flexible member selectively engaging said setting tool and said packer;

providing a shearable support for said flexible member to selectively retain it against the packer.

5. The method of claim 4, further comprising:

breaking said shearable support;

releasing said setting tool from said packer.

6. The method of claim 4, further comprising:

using at least one hydraulic piston on said setting tool to move a setting sleeve on the packer;

raising pressure on said piston to move said setting sleeve while said flexible member holds said setting tool to said packer.

7. The method of claim 6, further comprising:

stacking pistons on said setting tool;

applying pressure on each of said pistons to move said setting sleeve.

8. The method of claim 7, further comprising:

conducting a pressure supply from the surface around most of said whipstock;

conducting said pressure supply through said whipstock;

providing an outlet from said whipstock for the pressure supply;

providing a cavity in said setting tool in flow communication with said outlet and said pistons for actuation thereof.

9. The method of claim 2, further comprising:

eliminating at least one potential leakpath through said packer by removal of seals from the packer used in conjunction with setting the packer, by virtue of removal of said setting tool.

10. A method of milling a window downhole, comprising:

connecting a whipstock, a milling device, a setting tool, and a packer into an assembly;

running said assembly into a wellbore;

setting the packer;

using said milling device to mill a window;

releasing the setting tool from the packer;

removing said setting tool when removing said whipstock.

11. The method of claim 10, further comprising:

exposing a seal bore in said packer by removal of said setting tool;

inserting tubing into said packer;

sealing said tubing to said seal bore in said packer.

12. The method of claim 10, further comprising:

providing at least one piston and associated sealing on said setting tool;

actuating said piston with fluid pressure;

shifting a setting sleeve on said packer by movement of said piston;

removing said piston and associated sealing from the packer;

eliminating at least one potential leakpath through said packer by removal of said piston and associated sealing.

13. The method of claim 10, further comprising:

using a wireline-settable packer;

removing an actuating mechanism for a setting sleeve from the wireline-settable packer;

inserting said setting tool in place of said removed actuating mechanism.

14. The method of claim 10, further comprising:

using a window mill and at least one watermelon mill as said milling device.

15. The method of claim 14, further comprising:

milling the entire window in a single trip into the wellbore.

16. The method of claim 11, further comprising:

providing at least one piston and associated sealing on said setting tool;

actuating said piston with fluid pressure;

shifting a setting sleeve on said packer by movement of said piston;

removing said piston and associated sealing from the packer;

eliminating at least one potential leakpath through said packer by removal of said piston and associated sealing.

17. The method of claim 16, further comprising:

using a wireline-settable packer;

removing an actuating mechanism for a setting sleeve from the wireline-settable packer;

inserting said setting tool in place of said removed actuating mechanism.

18. The method of claim 17, further comprising:

using a window mill and at least one watermelon mill as said milling device.

19. The method of claim 18, further comprising:

milling the entire window in a single trip into the wellbore.

* * * * *